US005219100A

United States Patent [19]

Beck et al.

[11] Patent Number: 5,219,100

[45] Date of Patent: Jun. 15, 1993

[54] FLAP CLOSURE LOCKABLE IN AN OPEN POSITION

[75] Inventors: James M. Beck, Carol Stream; Terry E. Kubitz, Cary; Alex Kutaj, Vernon Hills, all of Ill.

[73] Assignee: Creative Packaging Corp., Buffalo Grove, Ill.

[21] Appl. No.: 869,390

[22] Filed: Apr. 16, 1992

[51] Int. Cl.[5] ..... B65D 47/00

[52] U.S. Cl. ..... 222/480; 222/556; 215/235; 220/335

[58] Field of Search ..... 222/480, 565, 556; 215/235; 220/335, 337, 339

[56] References Cited

U.S. PATENT DOCUMENTS

| | | | |
|---|---|---|---|
| 3,262,606 | 7/1966 | Waterman | 222/480 X |
| 4,369,901 | 1/1983 | Hidding | 222/480 |
| 4,399,928 | 8/1983 | Klingler | 220/335 |
| 4,402,435 | 9/1983 | Libit | 222/556 |
| 4,441,637 | 4/1984 | Libit | 222/556 |
| 4,693,399 | 9/1987 | Hickman et al. | 222/480 |
| 4,714,181 | 12/1987 | Kozlowski et al. | 222/480 |
| 4,723,693 | 2/1988 | DeCoster | 222/480 X |
| 4,821,899 | 4/1989 | Nycz et al. | 222/556 X |
| 4,881,668 | 11/1989 | Kitterman et al. | 222/556 X |

*Primary Examiner*—Kevin P. Shaver

*Attorney, Agent, or Firm*—Silverman, Cass & Singer, Ltd.

[57] ABSTRACT

A closure for a container opening including a closure body having a predetermined configuration, external periphery and a first aperture formed therethrough, a member for connecting the closure body about the container opening, a cover member reciprocally mounted about a portion of the external periphery of the closure body, the cover member including a first lid member hingedly connected thereto for rotation with respect to the cover member and the closure body and closing engagement with the first aperture, and a first locking member for releasably retaining the first lid member a predetermined distance away from the first aperture to maintain the first aperture in an uncovered condition during dispensing of the container contents, the first locking member including at least one engagement wing integral with the first lid member for engaging a portion of the closure body.

4 Claims, 3 Drawing Sheets

Fig. 4
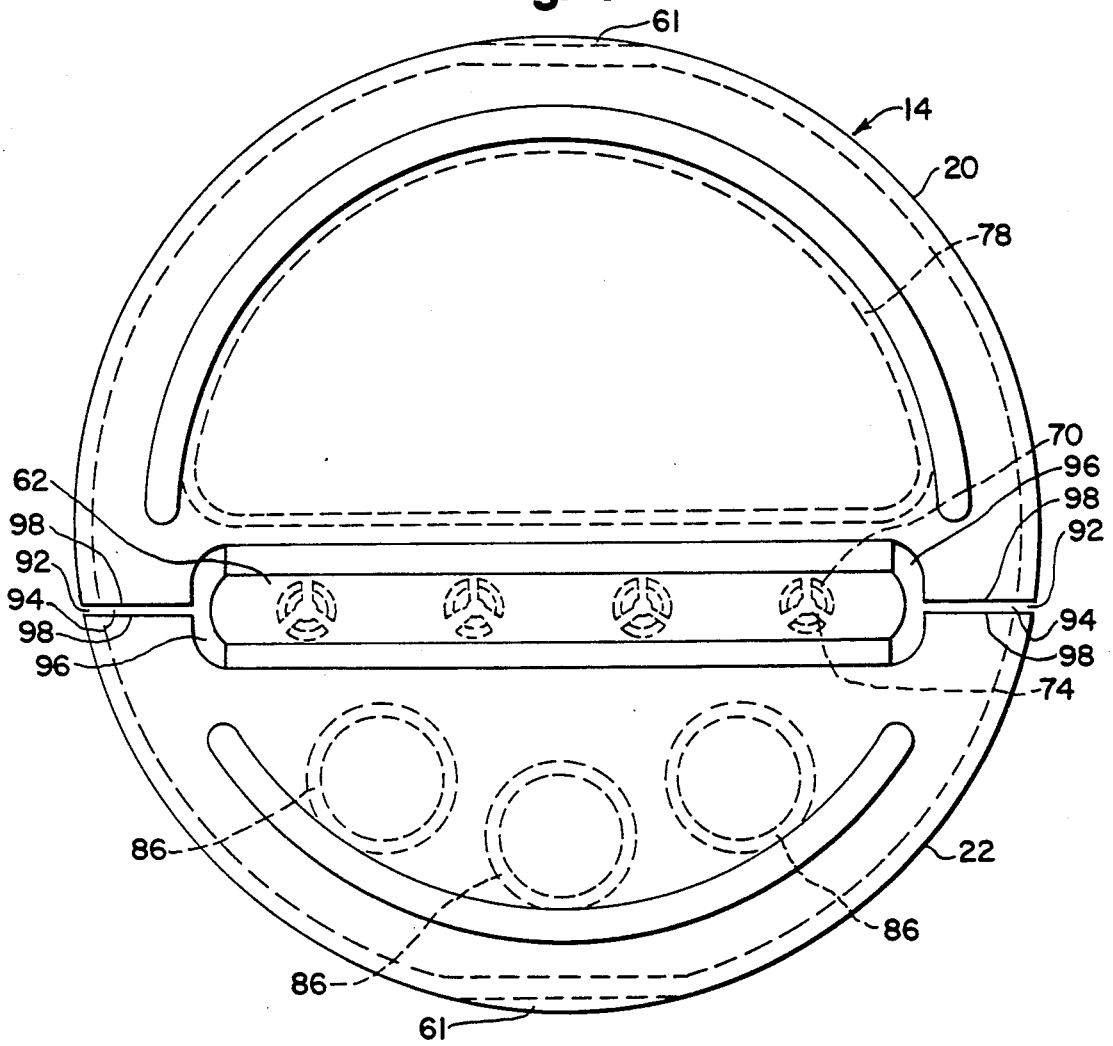
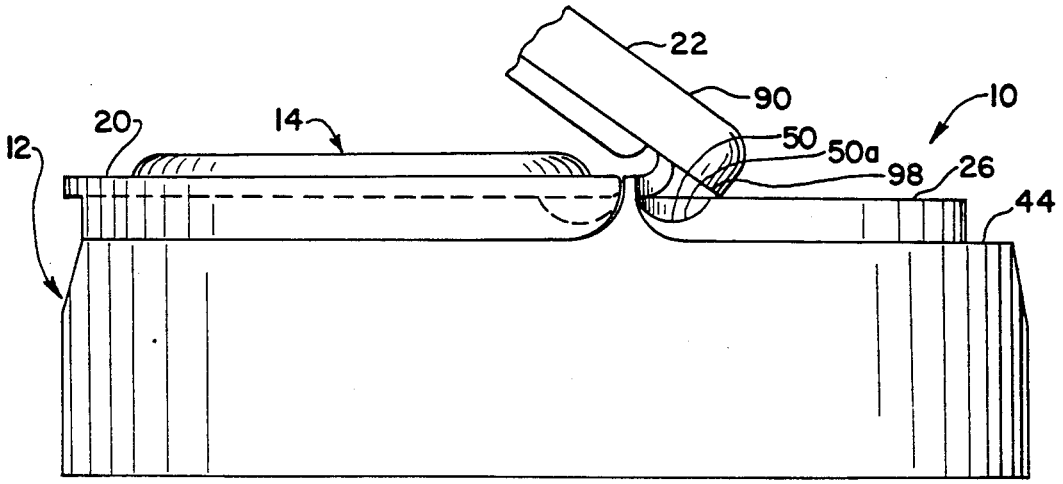
Fig. 5

Fig. 6
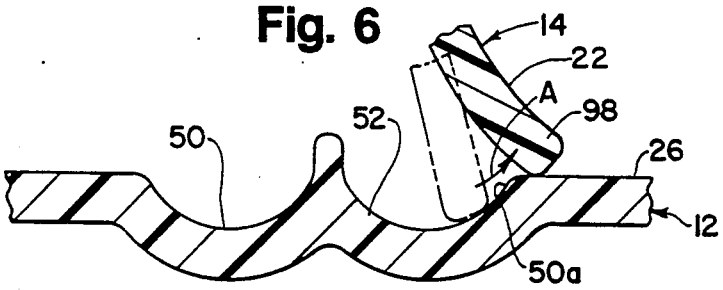
Fig. 7 PRIOR ART
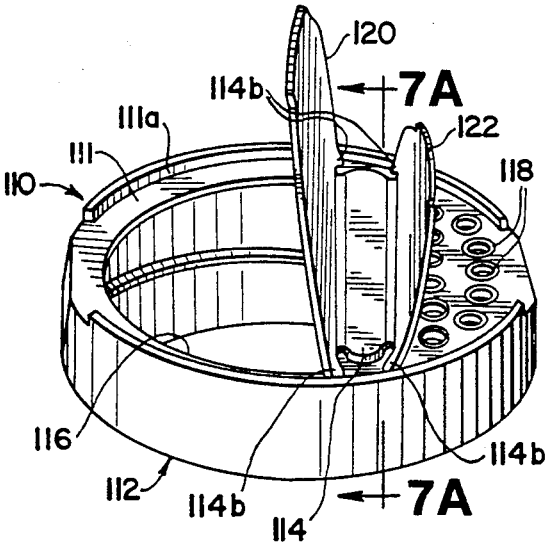
Fig. 7A PRIOR ART
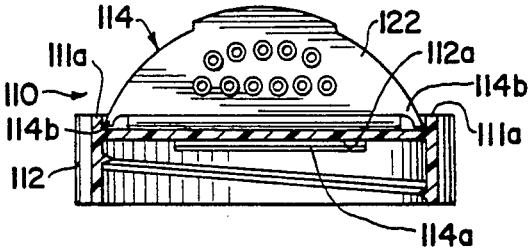
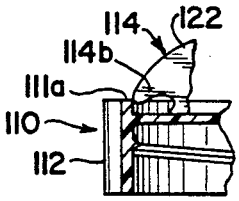
Fig. 7B PRIOR ART
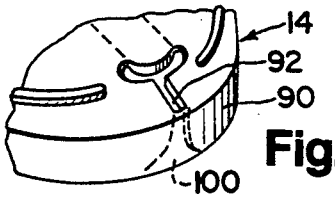
Fig. 8
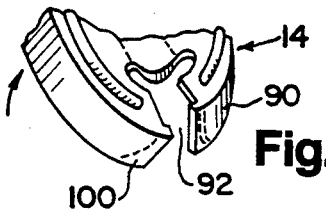
Fig. 9
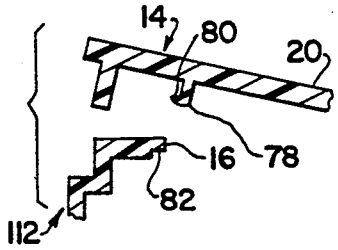
Fig. 10
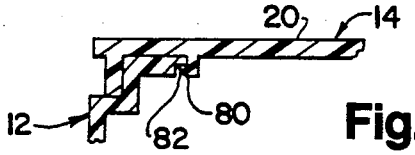
Fig. 11

FLAP CLOSURE LOCKABLE IN AN OPEN POSITION

BACKGROUND OF THE INVENTION

1. Field of the Invention

This invention relates generally to dispensing closures for containers, and more particularly, to a closure having one or more apertures which are opened and closed by a respective lid or flap which is hingedly connected to the closure, can be locked in an open position with respect to the closure to enable dispensing of the container contents without interference by the flap and is not susceptible to build-up of container contents or other matter about the closure apertures.

2. Description of the Related Art

Flap-type closures typically include a lid member which forms the flap and is hingedly connected to the closure to cover and uncover an aperture formed in the closure and allow dispensing of the container contents. Such closures typically are utilized with granular container contents such as sugar, spice, grated cheese and similar products.

FIGS. 7, 7*a* and 7*b* illustrate an example of an existing flap closure having a body member including a female portion formed by an annular recess in its top surface to include an annular ridge about the periphery of the top surface. A corresponding male cover member having two lid or flap members is seated within the annular recess where one larger lid hingedly covers a first large aperture and the other smaller lid hingedly covers a set of second apertures. This closure enables only the smaller lid covering the set of second apertures to be restrained in its fully opened position by the use of a narrow depending leg member on either side of the smaller lid member. Upon full opening of the smaller lid member, restraining is provided by a portion of the distal end of each leg which snaps into engagement with a portion of the top surface of the inwardly narrowing arc of the annular ridge formed about the periphery of the cover member.

The engagement force provided by the legs of such a closure is not very strong and can only be provided for the smaller lid due to the annular shape of the ridge where leg engagement depends upon the inwardly narrowing arc of the ridge. Additionally, the design of the body to include an annular female recess for accepting the male cover therein enables container contents or other matter to accumulate within the recess. This creates an undesirable and unsanitary condition by inhibiting proper operation of the legs and providing accumulation of spoiled contents about the recess which can be consumed and/or contaminate the remaining contents within the container.

It therefore is desirable to provide a flap closure having one or more lids or flaps which are hingedly connected to the closure to cover and uncover apertures in the closure where the lids can be securely looked in an open position with respect to the apertures to avoid interfering with the flow of the contents out of the container while reducing accumulation of contents about the closure.

SUMMARY OF THE INVENTION

The invention provides a closure for a container opening including a closure body having a predetermined configuration, external periphery and a first aperture formed therethrough and a member for connecting the closure body about the container opening. A cover member is reciprocally mounted about a portion of the external periphery of the closure body and includes a first lid member hingedly connected thereto for rotation with respect to the cover member and the closure body and closing engagement with the first aperture. A first locking member also is included for releasably retaining the first lid member a predetermined distance away from the first aperture to maintain the first aperture in an uncovered condition during dispensing of container contents, the first locking member including at least one engagement wing integral with the lid member for engaging a portion of the closure body.

BRIEF DESCRIPTION OF THE DRAWINGS

FIG. 4 is a top plan view of the cover member of the closure of the invention illustrating the details of the inside surface thereof in dotted outline;

FIG. 5 is a side elevational view of the closure of FIG. 3 illustrating the locking mechanism thereof;

FIG. 6 is an enlarged fragmentary cross-sectional view of the looking mechanism of FIG. 5;

FIG. 7 is a perspective view of a prior art two-flap closure illustrating both flaps in their unrestrained opened positions:

FIG. 7A is a cross-sectional view of the prior art closure taken along line 7A—7A of FIG. 7 and in the direction indicated generally illustrating the engagement of the legs of the smaller lid member with the body of the closure in the unrestrained position of the legs;

FIG. 7B is an enlarged fragmentary view of a portion of the prior art closure of FIGS. 7 and 7A illustrating an engagement leg of the smaller lid member in its restrained position with respect to the top surface of the annular rim of the recess of the closure body; FIG. 8 is an enlarged fragmentary perspective view of a portion of the lid members of the invention illustrating a tamper-evident feature of the closure in its unopened condition;

FIG. 9 is an enlarged fragmentary perspective view of a portion of the lid members, similar to FIG. 8, illustrating the tamper-evident feature of the closure in its opened or broken condition;

FIG. 10 is an enlarged cross-sectional view of the closure of the invention illustrating the mechanism for engaging the lid members to the body portion of the closure just prior to engagement; and FIG. 11 is an enlarged cross-sectional view of the closure of the invention, similar to FIG. 10, illustrating the mechanism for engaging the lid members to the body portion of the closure in its closed or engaged position.

DESCRIPTION OF THE PREFERRED EMBODIMENTS

Figure 1:
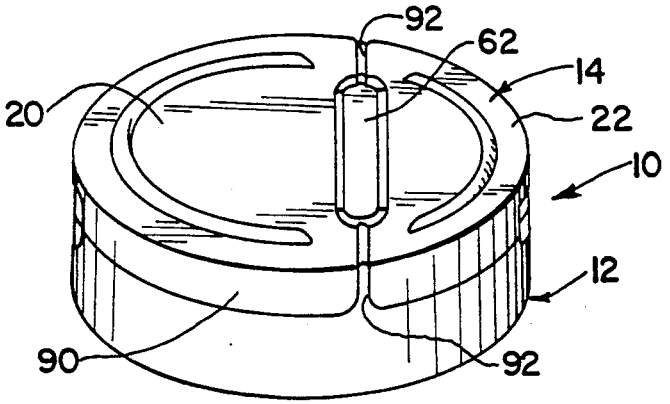
FIG. 1 is a perspective view of the closure of the invention in its fully closed position.
Figure 2:
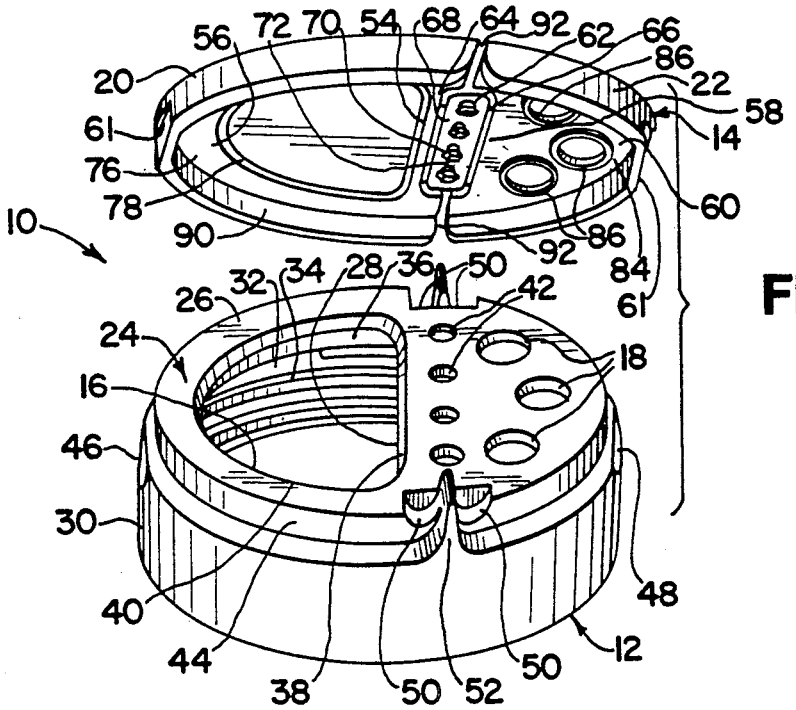
FIG. 2 is a perspective exploded view of the closure of FIG. 1 illustrating the closure body and cover member of the invention.
Figure 3:
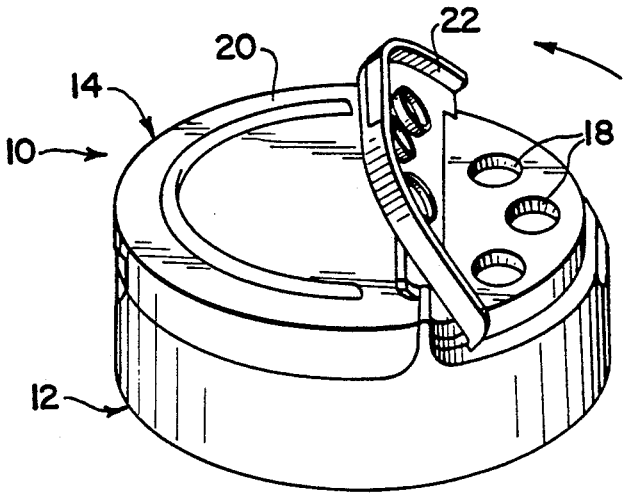
FIG. 3 is a perspective view of the closure of the invention, similar to FIG. 1, illustrating one lid member of the cover member in its open locked position.

Referring to FIGS. 1-3, the dispensing closure of the invention is designated generally by the reference numeral. 10. The closure 10 substantially is cylindrical in shape and includes a male body portion 12 and a female cover portion 14 reciprocally mounted about the male body portion 12.

Preferably, the closure 10 is threadingly engaged about a container opening (not illustrated) and is formed from plastic material. It is to be noted, however, that the particular material and engagement of the closure 10 with a container can vary within the contemplated scope of this invention.

As FIG. 2 illustrates, the closure 10 preferably is a two-flap type of closure where the body portion 12 includes a first enlarged aperture 16 and a set of second smaller apertures 18 to provide for dispensing of large and small quantities of container contents, respectively. To cover and/or seal the first aperture 16 and the set of second apertures 18, the cover 14 includes first and second complementary lid or flap members 20 and 22. A detailed operation of the closure 10 will be provided hereinafter.

Briefly, FIGS. 7, 7A and 7B illustrate a prior art twoflap closure 110 having a body portion 112 which includes an enlarged aperture 116, a plurality of smaller apertures 118, an annular recess 111 and corresponding upstanding peripheral rim or ridge 111*a*. A cover member 114 is seated within the recesses 111 and connected thereto by an elongate rib 114*a* formed with the cover member 114 and extending through an aperture 112*a* formed in the body portion 112. The cover member 114 includes first and second lid members 120 and 122 hingedly connected to the cover member 114 and narrow legs 114*b*, two each formed on the lid members 120 and 122. As FIGS. 7 and 7A illustrate, the legs 114*b* are mounted and contained within the recess 111 during rotation of both lid members 120 and 122. FIG. 7B illustrates the restraining of the lid member 122. Specifically, as the lid member 122 is rotated past the position illustrated in FIG. 7 with the opposing lid 120 fully closed within the recess 111 (not illustrated) the legs 114*b* on the lid member 122 ride up along the ridge 111*a* and engage a small portion of the top surface of the ridge 111*a*. Thereafter, the lid 122 can be rotated to its closed position with the legs 114*b* returning to seat within the recess 111. No restraining of the larger lid 120 is disclosed and does not appear possible since the arc of the ridge 111*a* proximate the legs 114*b* of the lid 120 increases outward.

Due to the reliance of the prior art closure 110 of FIGS. 7, 7A and 7B on the engagement between the legs 114*b* and the top surface of the ridge 111*a* and the decreasing arc of the ridge 111*a* for the restraining feature of the lid 122, such restraining is relatively weak, requires precise tolerances and readily can fail, especially after repeated use. Additionally, the recess 111 typically becomes a catch for excess container contents and other matter which tends to accumulate within the recess 111 and is quite difficult to remove, especially with small closures. This excess material readily can inhibit operation of the restraining feature and provides an undesirable unsanitary condition.

As will be described in detail below, the closure 10 of the present invention overcomes the drawbacks of the prior art closure 110 by providing a lock open feature for both the first larger and second smaller lids 20 and 22 having increased holding power thereby reducing failure and which accommodates a range of dimensional tolerances. Additionally, the design of the body portion 12 being a male member and the cover 14 being female reduces build up of excess material about the closure 10.

As FIG. 2 illustrates, the body 12 of the closure 10 preferably includes a top annular cap member 24 having a first top surface 26 and a second bottom surface 28 and a depending annular skirt portion 30. To connect the body 12 to a container, an inside surface 32 of the skirt portion 30 preferably includes threads 34 for corresponding threaded engagement with the container. To provide a seal between the container rim (not illustrated) and the body 12, the inside bottom surface 28 of the top cap 24 can include an annular shoulder 36.

The first enlarged aperture 16 preferably is formed in the shape of the letter "D" by a linear side wall 38 and a corresponding arcuate side wall 40. In use, the aperture 16 typically enables dispensing of large quantities of container contents and provides access for a measuring spoon or the like.

The set of smaller apertures 18 is positioned on the side of the top cap 24 opposite the enlarged aperture 16. Preferably, three apertures 18 are provided each of a circular configuration and aligned along an arc, but the number, shape and alignment of the apertures 18 can vary. In use, the apertures 18 typically enable dispensing of smaller quantities of container contents which are shaken out of the container.

To reciprocally connect the cover 14 about the body 12, the top cap 24 preferably includes a set of four apertures 42 provided through the top cap 24 and positioned in a line extending across the top cap 24 between the first aperture 16 and the set of second apertures 18. As will be explained below, tee apertures 42 snappingly accept corresponding engagement lugs of the cover portion 14 in a releasable manner.

To seat the cover 14 about the body 12 in the preferred reciprocal manner, the outer periphery of the top cap 24 includes a shoulder 44 formed thereabout having a predetermined width. To enable a user to readily engage the first and second lids 20 and 22, finger wells 46 and 48, respectively, can be formed on opposite sides of the skirt 30 proximate the shoulder 44.

To provide the desired lock open feature, the top cap 24 includes two pairs of channels 50, one pair each positioned on opposite sides or the margin of the top surface 26. Preferably, each channel 50 is arcuate and depends a predetermined distance into the interior of the top cap 24. Each pair of channels 50 is separated by a land 52 and the longitudinal axis of corresponding channels 50 of respective pairs substantially are in alignment. Additionally, the lands 52 preferably extend above the top surface 26 of the top cap 24, but can be flush with the surface 26 if desired. To assist in providing the lock open feature as will be described below, a side wall 50*a* of each channel 50 opposite the land 52 can be formed as linear, rather than arcuate, or can include an engagement rib (not illustrated).

Each lid 20 and 22 preferably is formed in the shape of the letter "D". The first lid 20 is defined by a linear wall 54 and an arcuate wall 56 while the second lid 22 is defined by a linear wall 58 and an arcuate wall 60. To assist in opening the lids 20 or 22, finger portions 61 can be formed on a central peripheral portion of each arcuate wall 56 or 60 of the lids 20 and 22 respectively.

To hingedly connect the first and second lids 20 and 22 to the cover 14, the cover 14 includes an intermediate connecting land portion 62. The connecting land 62 is connected on a first side longitudinal side by a thin walled portion 64 of the cover 14 to the linear wall 54 of the first lid 20 and on a second opposite longitudinal side by a similar thin walled portion 66 of the cover 14 to the linear wall 58 of the second lid 22.

To connect the cover 14 to the body 12, the connecting land 62 includes a bottom surface 68 which preferably includes a set of four engagement lugs 70. The lugs 70 snappingly engage into the corresponding apertures 42 of the body 12 through ribs 72 on the distal ends of the lugs 70. As FIG. 4 illustrates, if desired, to assist in flexing of the lugs 70, each lug 70 preferably can be split into three longitudinal sections by corresponding slits 74. Additionally, one or more of the lugs 70 can have a different length or shape (not illustrated) to assist in locating the cover 14 with the body 12.

As FIGS. 2 and 4 illustrate, to close the first lid 20 with respect to the aperture 16, a bottom side 76 of the first lid 20 includes a depending engagement rib 78 substantially corresponding to the shape and size of the aperture 16. As FIGS. 10 and 11 illustrate, the rib 78 preferably includes an engagement barb 80 formed thereon for corresponding snapping engagement with a recess 82 formed about the inside edge of the aperture 16. The barb 80 can extend about the entire periphery of the rib 78, just a portion thereof or can be formed as two or more discrete portions about the periphery of the rib 78 where the discrete portions are positioned in desired locations and have predetermined lengths.

Similarly, as FIGS. 2 and 4 illustrate, to close the second lid 22 with respect to the set of apertures 18, a bottom side 84 of the second lid 22 includes three engagement ribs 86, one each for a corresponding aperture 18. Preferably, only the center rib includes a barb 88 thereon (not illustrated) which can extend about the periphery of the rib 86*a* or only one or more portions thereof. It is to be noted, however, that the remaining ribs 86 also can include such a barb 88 if desired.

To reciprocally mount the cover 14 about the body 12, the cover 14 preferably includes a depending flange 90 formed thereon which extends about the periphery of the arcuate walls 56 and 60 of the lids 20 and 22, respectively. As FIG. 1 illustrates, the flange 90 seats within and covers the outer shoulder 44 of the body 12.

To provide the lock open feature of the closure 10, the cover 14 includes a slot 92 formed on opposite sides thereof proximate the longitudinal center line of the connecting land 62. As FIG. 4 illustrates, the slots 92 extend through the cover 14 and extend a predetermined distance into the interior surface of the cover 14. Preferably, each slot 92 is in the form of the letter "Y" having a base or stem portion 94 and a yoke portion 96 with the yoke portion 96 being positioned on the interior of the cover 14.

Accordingly, the slots 92 form wing portions 98, two each on the first and second lids 20 and 22 which are positioned on opposite sides of the lids 20 and 22. As described below, each wing 98 rotates within a respective channel 50 of the body 12 and snaps into engagement with the top surface 26 proximate the channels 50 to provide the desired lock open feature.

To assemble the closure 10, the lugs 70 of the cover 14 are aligned with and inserted into the apertures 42 of the body 12. After each rib 72 of the lugs 70 clears the bottom of the apertures 42, the cover 14 is releasably engaged with the body 12.

In use, after assembly, the lids 20 and 22 are rotated about their respective hinges 64 and 66 to the closed position so that the engagement ribs 78 and 86 and corresponding barb portions 80 snappingly engage the recesses 82 of the apertures 16 and 18. This provides the closure 10 in its closed position which in turn can be threadingly engaged with a container. Alternatively, the body 12 first can be attached to a container and then the cover 14 attached to the body 12 as described above.

To open one or the other lid 20 or 22, a user engages a respective finger portion 61 and then snaps open a lid 20 or 22 and rotates that lid about a respective hinge 64 or 66 to a partially opened or fully opened position. During rotation of the lid 20 or 22, the wing portions 98 on either side of the lid 20 or 22 rotate through the arcuate channel 50 to engage the side wall 50*a* thereof.

To lock open the lid 22, for example, as FIG. 6 illustrates, the cover 14 is dimensioned and mounted to the body 12 so that the wings 98 will slightly defect or flex upon continued rotation and contact with the side wall 50*a* until they clear the side wall 50*a*. At that point, the wings 98 snap upward in the direction of arrow "A" until the wings 98 snappingly engage the top surface 26 of the body 12. This maintains the lid 22 in its locked open position and container contents can be dispensed through the apertures 18 without interference from the lid 22.

It is to be noted that the lid 20 operates substantially in the same manner. Additionally, the size and shape of the wings 98 and/or channels 50 and side walls 50*a* can be modified to vary the locking force. Due to the substantial length of the channels 50 and wings 98, locking engagement is provided over a relatively large surface area which can be lengthened or shortened as desired.

To close the lid 20 or 22, the respective lid 20 or 22 merely is rotated back toward the body 12 until the wings 98 flex back into their respective channels 50.

FIGS. 8 and 9 illustrate a tamper-evident feature of the closure 10. The portion of the slot 92 which extends through the flange 90 of the cover 14 can include a frangible portion 100 extending thereacross. As FIG. 9 illustrates, when either flap 20 or 22 initially is opened, the frangible portion 100 is broken, thereby providing evidence of tampering. It is to be noted that the mounting connection between the cover 14 and body 12 which is provided by the lugs 70 and ribs 72 of the cover 14 and the apertures 42 of the body 12 is significantly strong and inaccessible from the extension of the closure 10 to restrict removal of the cover 14 without severing the frangible portions 100.

Modifications and variations of the present invention are possible in light of the above teachings. A specific dimension, material, or construction is not required so long as the assembled device is able to function as herein described. It is therefore to be understood that within the scope of the appended claims, the invention may be practiced otherwise than as specifically described.

What is claimed and desired to be secured by letters patent of the United States is:

1. A closure for a container opening, comprising:

a closure body having a predetermined configuration, external periphery and a first aperture formed therethrough;

means for connecting said closure body about the container opening;

a cover member reciprocally mounted about a portion of said external periphery of said closure body, said cover member including a first lid member hingedly connected thereto for rotation with respect to said cover member and said closure body and closing engagement with said first aperture; and first locking means for releasably retaining said first lid member a predetermined distance away from said first aperture to maintain said first aperture in an uncovered condition during dispensing of container contents, said first locking means including at least one engagement wing integral with said first lid member for engagement with at least one channel formed in said closure body, said wing being rotatable within said channel, deflectable upon engagement with a portion of said channel sidewall proximate an open top end of said channel and resiliently engageable with a top surface of said closure body proximate said channel to provide said releasable retaining.

2. A closure for a container opening, comprising:

a body portion having a substantially planar annular top cap member including a first top surface and a second bottom surface, an annular skirt member connected to and depending from said second bottom surface of said top cap member, a first aperture formed through said top cap member of said body portion having a predetermined configuration and size, a set of second apertures formed through said top cap member of said body portion having a predetermined arrangement, each of said second apertures having a predetermined configuration and a size smaller than said first aperture, two pairs of concave engagement channels, one pair each formed on opposite sides of the margin of said top surface of said top cap member, each channel within a given pair being arranged side by side with their longitudinal axis substantially parallel to each other, having a predetermined longitudinal length and extending into said top surface a predetermined distance, and means for connecting said skirt member about the container opening; and a substantially planar annular cover member reciprocally mounted to said body portion for cooperative engagement therewith, said cover member having an elongate land portion extending thereacross with first and second substantially planar lid members hingedly connected thereto on opposite longitudinal sides of said land portion for rotation with respect to said land portion and closing engagement with said first aperture and said set of second apertures, respectively, each of said first and second lid members including a pair of wing members, one wing of each pair being formed on opposite marginal sides of said first and second lid members for cooperative engagement with said engagement channels and said top surface of said body portion to provide locking of either of said first and second lid members in an open position with respect to said first aperture and said set of second apertures.

3. A closure for a container opening, comprising:

a closure body;

means for connecting said closure body about the container opening;

first and second apertures extending through said closure body;

first and second lid members directly hingedly connected to said closure body for rotation with respect to said closure body and closing engagement with said first and second apertures, respectively; and first and second locking means integrally formed with said closure body for releasably retaining said first and second lid members, respectively, a predetermined distance away from their respective first and second apertures and maintaining said first and second apertures in an uncovered condition during dispensing of container contents.

4. A closure for a container opening, comprising:

a body portion including a first top surface and a second bottom surface, means for connecting said body portion about the container opening, first and second apertures formed through said first top surface, each aperture having a predetermined configuration and size, two pairs of concave engagement channels, one pair each formed on opposite sides of the margin of said top surface with their longitudinal axis substantially parallel to each other; and a cover member reciprocally mounted about said body portion for cooperative engagement therewith, said cover member having first and second lid members hingedly connected thereto for rotation with respect to said cover member and closing engagement with said first and second apertures respectively, each of said first and second lid members including at least one wing member formed on a marginal side of said first and second lid members for cooperative engagement with a respective engagement channel and said top surface of said body portion to provide locking of either of said first and second lid members in an open position with respect to said first and second apertures.

* * * * *

UNITED STATES PATENT AND TRADEMARK OFFICE

CERTIFICATE OF CORRECTION

PATENT NO. : 5,219,100
DATED : June 15, 1993
INVENTOR(S) : James M. Beck, Terry E. Kubitz and Alex Kutaj It is certified that error appears in the above-indentified patent and that said Letters Patent is hereby corrected as shown below:

Column 1, line 58, change "looked" to --locked--;

Column 2, line 31, change "looking" to --locking--;

Column 2, line 45, change this line to read:
--annular rim of the recess of the closure body;
Fig. 8 is--;

Column 3, line 21, change "twoflap" to --two-flap--.

Signed and Sealed this

Fourth Day of January, 1994

Bruce Lehman

*Attest:*

BRUCE LEHMAN

*Attesting Officer*

*Commissioner of Patents and Trademarks*